US009846407B2

(12) United States Patent
Nakamura et al.

(10) Patent No.: US 9,846,407 B2
(45) Date of Patent: Dec. 19, 2017

(54) DEVELOPING MEMBER, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Minoru Nakamura, Mishima (JP); Kazuaki Nagaoka, Susono (JP); Yuto Miyauchi, Shioya-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/290,012

(22) Filed: Oct. 11, 2016

(65) Prior Publication Data

US 2017/0115595 A1 Apr. 27, 2017

(30) Foreign Application Priority Data

Oct. 23, 2015 (JP) ..... 2015-208985

(51) Int. Cl.
*G03G 21/16* (2006.01)
*G03G 21/18* (2006.01)
*G03G 15/08* (2006.01)

(52) U.S. Cl.
CPC ..... *G03G 21/18* (2013.01); *G03G 15/0818* (2013.01)

(58) Field of Classification Search
CPC ..... G03G 21/18; G03G 15/0818
See application file for complete search history.

(56) References Cited

U.S. PATENT DOCUMENTS

| | | | |
|---|---|---|---|
| 7,727,134 | B2 | 6/2010 | Nakamura et al. |
| 7,797,833 | B2 | 9/2010 | Nakamura et al. |
| 7,798,948 | B2 | 9/2010 | Kawamura et al. |
| 7,799,398 | B2 | 9/2010 | Nakamura et al. |
| 8,745,870 | B2 | 1/2014 | Kawamura et al. |
| 8,655,222 | B2 | 2/2014 | Nakamura et al. |
| 8,768,227 | B2 | 7/2014 | Urushihara et al. |
| 8,798,508 | B2 | 8/2014 | Yamada et al. |
| 8,874,007 | B2 | 10/2014 | Kawamura et al. |
| 9,261,811 | B2 | 2/2016 | Hagiwara et al. |
| 2008/0069601 | A1 | 3/2008 | Oshiba et al. |
| 2015/0355570 | A1 | 12/2015 | Koyanagi et al. |

FOREIGN PATENT DOCUMENTS

JP 2015-094897 5/2015

OTHER PUBLICATIONS

U.S. Appl. No. 15/337,629, filed Oct. 28, 2016, Kazuaki Nagaoka.

*Primary Examiner* — Hoang Ngo
(74) *Attorney, Agent, or Firm* — Fitzpatrick Cella Harper and Scinto

(57) ABSTRACT

A high-quality developing member having compatibility between high toner charging properties and high durability under high temperature and high humidity environments is provided. The developing member includes an electro-conductive substrate and an electro-conductive surface layer in this order. The surface layer includes a binder resin, an alumina particle and a polyester phosphate compound.

9 Claims, 2 Drawing Sheets

DEVELOPING MEMBER, PROCESS CARTRIDGE AND ELECTROPHOTOGRAPHIC IMAGE FORMING APPARATUS

BACKGROUND OF THE INVENTION

Field of the Invention

The present disclosure relates to a developing member incorporated into electrophotographic apparatuses such as copiers, printers and facsimile receivers, the developing member being brought into contact with or close to an image bearing member in use. The present disclosure also relates to a process cartridge and an electrophotographic image forming apparatus.

Description of the Related Art

In electrophotographic apparatuses such as copiers, fax machines and printers, an image bearing member is charged by a charging unit, and an electrostatic latent image is formed by a laser. Next, a toner in the developing container is applied onto a developing member by a toner feed roller and a toner regulating member to develop the electrostatic latent image with the toner by bringing the image bearing member into contact with or close to the developing member. Subsequently, the toner on the image bearing member is transferred onto a recording paper by a transferring unit, and the toner on the recording paper is fixed under heat and pressure. The residual toner on the image bearing member is removed by a cleaning blade.

Image forming apparatuses of a non-magnetic one-component contact developing system typically include an electro-conductive electrophotographic member having a volume resistivity of $10^3$ to $10^{10}$ Ωcm as the developing member. Higher performance has been required for the developing member for electrophotographic image forming apparatuses, and two-layer developing members including an electro-conductive elastic layer and an electro-conductive surface layer disposed on the surface of the electro-conductive elastic layer have been increasingly used from the viewpoint of high image quality and high durability. The electro-conductive surface layer broadly used is composed of a urethane resin having high resistance to wear and toner charging properties. Recently, to attain higher function, Japanese Patent Application Laid-Open No. 2015-094897 discloses that enhanced toner charging properties can be provided by containing alumina in a surface layer and thus high-quality images can be provided.

SUMMARY OF THE INVENTION

One aspect of the present disclosure is directed to providing a developing member that can sufficiently charge a toner even under high temperature and high humidity environments. Another aspect of the present disclosure is directed to providing an electrophotographic image forming apparatus and a process cartridge which can form high-quality electrophotographic images even under high temperature and high humidity environments.

According to one aspect of the present disclosure, there is provided a developing member including an electro-conductive substrate and an electro-conductive surface layer in this order, the surface layer containing a binder resin, an alumina particle and a polyester phosphate compound.

According to another aspect of the present disclosure, there is provided a process cartridge configured to be detachably attachable to the main body of an electrophotographic image forming apparatus, the process cartridge including a developing apparatus, and the developing apparatus including the developing member.

According to further another aspect of the present disclosure, there is provided an electrophotographic image forming apparatus including an image bearing member bearing an electrostatic latent image, a charging apparatus charging the image bearing member, an exposure apparatus forming an electrostatic latent image on the charged image bearing member, a developing apparatus developing the electrostatic latent image with a toner to form a toner image, and a transfer apparatus transferring the toner image onto a transfer material, the developing apparatus including the developing member.

Further features of the present invention will become apparent from the following description of exemplary embodiments with reference to the attached drawings.

DESCRIPTION OF THE EMBODIMENTS

Figure 1:
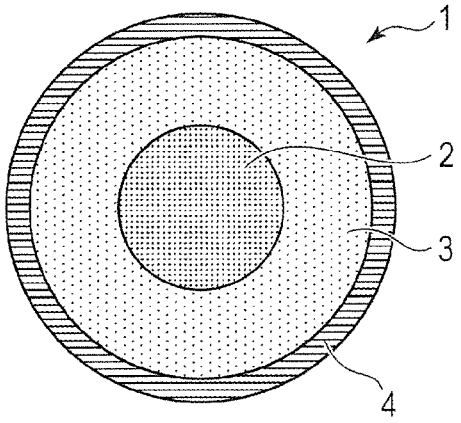
FIG. 1 is a conceptual diagram illustrating one example of the developing member according to the present disclosure.

Preferred embodiments of the present disclosure will now be described in detail in accordance with the accompanying drawings.

Electrophotographic apparatuses, which are used all over the world, are required to output electrophotographic images of high quality under a variety of environments. For this reason, the present inventors recognize the necessity of the performance of the developing member that can give sufficient charges to the toner under high temperature and high humidity environments (for example, a temperature of 30° C. and a relative humidity of 95% (95% RH)).

The present inventors have examined the developing member disclosed in Japanese Patent Application Laid-Open No. 2015-094897, and unfortunately have found that leakage of charges of the toner borne on the surface of the developing member readily occurs under high temperature and high humidity environments. Namely, while a tribo-charged toner is being conveyed by the developing member to a region to be developed, the charging amount thereof sometimes undesirably reduces due to leakage of the charges of the toner to the developing member before the toner reaches the region to be developed.

The present inventors have examined the reason that the developing member disclosed in Japanese Patent Application Laid-Open No. 2015-094897 cannot sufficiently prevent a reduction in the charging amount of a toner under high temperature and high humidity environments in some cases. From the results, the present inventors have considered that although a developing member including a surface layer containing a strongly negative charging material such as an alumina particle demonstrates high toner charging properties, the developing member cannot prevent the leakage of the charges of the toner still because the developing member itself is electro-conductive. Namely, it is considered that charging of the toner and the leakage of the charges of the toner are generated competitively.

The present inventors, who have conducted further research, have found that a developing member including a surface layer containing an alumina particle and a polyester phosphate compound is unlikely to cause decay of the charging amount of a toner even under high temperature and high humidity environments while the toner is being conveyed to the region to be developed.

The present inventors consider the following reason that such a developing member attains the advantageous effect above. Namely, charges leaked from the tribocharged toner, which is borne on the surface of the developing member, to the developing member are first trapped by polyester phosphate in the surface layer. The charges trapped by polyester phosphate are then fed to the alumina particle present near polyester phosphate to enhance the toner charging properties (charge providing ability) of the developing member. In other words, it is considered that the developing member according to the present invention has a function to return the charges leaked from the toner back to the toner.

The developing member according to the present invention in the form of a roller (developing roller) will now be described, but the form of the developing member will not be limited to this.

As illustrated in FIG. 1, a developing member 1 according to the present invention in the form of a roller is an electro-conductive member including an electro-conductive substrate 2, an electro-conductive elastic layer 3 formed on the outer peripheral surface of the substrate 2, and an electro-conductive surface layer 4 covering and disposed on the outer peripheral surface of the electro-conductive elastic layer 3. The electro-conductive elastic layer 3 interposed between the electro-conductive substrate and the electro-conductive surface layer, is not an essential component. According to one aspect, the developing member according to the present invention also has a configuration including the electro-conductive substrate 2 and the electro-conductive surface layer 4 directly disposed on the surface of the substrate 2.

[Electro-conductive Substrate]

The electro-conductive substrate functions as an electrode and a supporting member of the developing member. The electro-conductive substrate has a cylindrical or hollow cylindrical shape, and includes one of the following electro-conductive materials: metals or alloys such as aluminum, copper alloys and stainless steel; chromium- or nickel-plated iron; and synthetic resins having electro-conductivity. A known adhesive may be appropriately applied onto the surface of the electro-conductive substrate to enhance the adhesiveness to the electro-conductive elastic layer.

[Electro-conductive Elastic Layer]

The electro-conductive elastic layer as an optional component gives hardness and elasticity to the developing member so as to press the developing member against the image bearing member with an appropriate nip width and nip pressure such that an appropriate amount of the toner can be fed to the electrostatic latent image formed on the surface of the image bearing member. The electro-conductive elastic layer can be typically formed of a molded article of a rubber material. Examples of the rubber material include: ethylene-propylene-diene copolymerization rubber (EPDM), acrylonitrile-butadiene rubber (NBR), chloroprene rubber (CR), natural rubber (NR), isoprene rubber (IR), styrene-butadiene rubber (SBR), fluoro rubber, silicone rubber, epichlorohydrin rubber, hydride of NBR and urethane rubber. These rubber materials can be used singly or in combination. Among these rubber materials, particularly silicone rubber can be used because silicone rubber is unlikely to generate compression set in the electro-conductive elastic layer after the developing member is brought into contact with other members (such as a toner regulating member) for a long time. Examples of the silicone rubber specifically include cured products of addition-curable silicone rubber.

The electro-conductive elastic layer includes an electro-conductive agent such as an electron conductive substance or an ion conductive substance in the rubber material, and the resistance of the electro-conductive elastic layer is adjusted to an appropriate resistance region (volume resistivity) of preferably $10^3$ Ωcm or more and $10^{11}$ Ωcm or less, more preferably $10^4$ Ωcm or more and $10^{10}$ Ωcm or less.

Examples of the electron conductive substance include the following substances: electro-conductive carbons such as ketjen black EC and acetylene black; carbons for rubber such as SAF, ISAF, HAF, FEF, GPF, SRF, FT and MT; carbon for color (ink) subjected to an oxidation treatment; and metals such as copper, silver and germanium and metal oxides thereof. Among these electron conductive substances, carbon black [electro-conductive carbon, carbon for rubber, carbon for color (ink)] can be used because a small amount thereof readily controls the electro-conductivity.

Examples of the ion conductive substance include the following substances: inorganic ion conductive substances such as sodium perchlorate, lithium perchlorate, calcium perchlorate and lithium chloride; and organic ion conductive substances such as modified aliphatic dimethylammonium ethosulfate and stearylammonium acetate.

These electro-conductive agents are used in an amount needed to control the electro-conductive elastic layer so as to have an appropriate volume resistivity. The amount typically used is in the range of 0.5 parts by mass or more and 50 parts by mass or less based on 100 parts by mass of the binder resin (rubber material).

The electro-conductive elastic layer can contain a variety of additives such as a plasticizer, a filler, an extender, a vulcanizing agent, a vulcanizing aid, a crosslinking aid, a curing suppresser, an antioxidant, an anti-aging agent and a process aid when necessary. Examples of the filler include silica, quartz powder and calcium carbonate. These optional components are compounded in the range not impairing the function of the electro-conductive elastic layer.

The electro-conductive elastic layer has an elasticity required for the developing member. The elasticity can be 20°or more and 80°or less in terms of Asker C hardness. The thickness can be 0.3 mm or more and 6.0 mm or less.

The materials for the electro-conductive elastic layer can be mixed with a dynamic mixing apparatus such as a monoaxial continuous kneader, a biaxial continuous kneader, a two-roll mill, a kneader mixer and a Tri-mix or a static mixing apparatus such as a static mixer.

The electro-conductive elastic layer can be formed on the electro-conductive substrate by any method such as mold molding, extrusion molding, injection molding or application molding. Examples of mold molding include a method of fixing a die for fixing an electro-conductive substrate to both ends of a cylindrical metal mold; forming injection holes in the die; then injecting a material for the electro-conductive elastic layer through the injection holes; subsequently heating the material at the curing temperature; and removing the mold. Examples of extrusion molding include a method of co-extruding an electro-conductive substrate and a material for an electro-conductive elastic layer with a crosshead type extruder, curing the material, and forming an electro-conductive elastic layer around the electro-conductive substrate.

The surface of the electro-conductive elastic layer can also be modified through a surface modification method such as polishing of the surface, a corona treatment, a flame treatment or an excimer treatment to enhance the adhesion to the electro-conductive surface layer.

[Electro-conductive Surface Layer]

At least a binder resin, an alumina particle and a polyester phosphate compound are present in the electro-conductive surface layer.

[Binder Resin]

Examples of the binder resin contained in the electro-conductive surface layer include: polyamide resins, nylon resins, urethane resins, urea resins, imide resins, melamine resins, fluorine resins, phenol resins, alkyd resins, polyester resins, polyether resins, acrylic resins, natural rubber, butyl rubber, acrylonitrile-butadiene rubber, polyisoprene rubber, polybutadiene rubber, silicone rubber, styrene-butadiene rubber, ethylene-propylene rubber, ethylene-propylene-diene rubber, chloroprene rubber and mixtures thereof.

Among these binder resins, urethane resins can be used as the binder resin for the electro-conductive surface layer because of its high resistance to wear. The urethane resin can be prepared from polyol and isocyanate, and when necessary a chain extender. Examples of the polyol as the raw material for a urethane resin include polyether polyol, polyester polyol, polycarbonate polyol, polyolefin polyol, acrylic polyol and mixtures thereof. Examples of the isocyanate as the raw material for a urethane resin include: tolylene diisocyanate (TDI), diphenylmethane diisocyanate (MDI), naphthalene diisocyanate (NDI), tolidine diisocyanate (TODI), hexamethylene diisocyanate (HDI), isophorone diisocyanate (IPDI), phenylene diisocyanate (PPDI), xylylene diisocyanate (XDI), tetramethylxylylene diisocyanate (TMXDI), cyclohexane diisocyanate and mixtures thereof. Examples of the chain extender as the raw material for a urethane resin include bifunctional low molecular diols such as ethylene glycol, 1,4-butanediol and 3-methylpentanediol; trifunctional low molecular triols such as trimethylolpropane; and mixtures thereof.

[Alumina Particle]

Examples of the alumina particle contained in the electro-conductive surface layer include: a particle of aluminum oxides such as α-alumina and γ-alumina, aluminum oxide hydrates such as boehmite and pseudo boehmite, aluminum hydroxide, and aluminum compounds prepared through a hydrolysis or condensation reaction of aluminum alkoxide. The alumina particle has an average particle size $D_{50}$ of preferably 10 nm or more and 10 μm or less, more preferably 15 nm or more and 3.0 μm or less from the viewpoint of efficient toner charging properties.

The alumina particle is used in an amount in the range of preferably 1.5 parts by mass or more and 350 parts by mass or less, more preferably 3.0 parts by mass or more and 200 parts by mass or less based on 100 parts by mass of the binder resin. The atomic concentration of aluminum (Al %) of the outermost surface of the electro-conductive surface layer can satisfy $1.50 \leq Al \leq 10.0$ to more significantly enhance the toner charging properties. The method of measuring the atomic concentration of aluminum will be described later.

[Polyester Phosphate Compound]

The polyester phosphate compound has a phosphoric acid skeleton and at least a polyester structure. Examples thereof include a compound represented by formula (1).

[Formula 1]

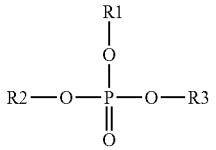

(1)

where at least one of R1 to R3 is a substituent having a polyester structure. Namely, if one of R1, R2 and R3 is a substituent having a polyester structure, the other two are a hydrogen atom, an alkyl group, an alkenyl group, an aralkyl group, an aryl group or a polyoxyalkylene group. If two of R1, R2 and R3 are substituents having a polyester structure, the other is a hydrogen atom, an alkyl group, an alkenyl group, an aralkyl group, an aryl group or a polyoxyalkylene group. If all of R1, R2 and R3 are substituents having a polyester structure, the substituents having a polyester structure may have the same polyester structure, or each independently may have different polyester structures.

Since a polyester phosphate compound has at least one substituent having a polyester structure among the three substituents (R1 to R3) included in phosphoric acid represented by formula (1), advantageous effects on toner charging properties of the developing member under high temperature and high humidity environments are exerted. The rest of the substituents may have a polyester structure or may have no polyester structure. In particular, it is verified that the advantageous effect of the developing member is demonstrated in a polyester phosphate compound having a typical organic substituent or a polyoxyalkylene group as the rest of the substituents. It is considered that the phosphoric acid skeleton and a large number of ester groups in the polyester structure in the molecule of the polyester phosphate compound essentially generate the synergetic effect with the alumina particle, and other structures in the molecule do not affect demonstration of the advantageous effect in particular.

The polyester structure refers to a polymer having an ester group prepared through polycondensation of dicarboxylic acid and diol or through polycondensation of hydroxycarboxylic acid, or a polymer prepared through ring-opening polymerization of a cyclic ester compound such as lactone. Examples of the dicarboxylic acid include: terephthalic acid, isophthalic acid, adipic acid, azelaic acid, sebacic acid, 2,6-naphthalenedicarboxylic acid and 1,4-cyclohexanedicarboxylic acid. Examples of the diol include: ethylene glycol, 1,4-butanediol, diethylene glycol, triethylene glycol, neopentyl glycol, 1,4-cyclohexanedimethanol and polyethylene glycol. Examples of the hydroxycarboxylic acid include p-hydroxybenzoic acid and 6-hydroxy-2-naphthoic acid. Examples of the cyclic ester compound include aliphatic lactones having 4 to 11 carbon atoms.

Among these polyester phosphate compounds, a polyester phosphate compound represented by formula (2) is particularly suitably used because this compound significantly demonstrates the advantageous effects of the developing member in combination with the alumina particle.

[Formula 2]

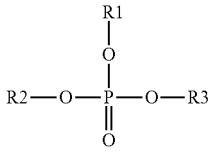

(2)

where R1 is selected from the group consisting of a substituent having a poly(ϵ-caprolactone) structure, or a substituent having a poly(δ-valerolactone) structure, and a substituent having a copolymer structure of ϵ-caprolactone and δ-valerolactone; and R2 and R3 are each independently selected from the group consisting of a hydrogen atom, an alkyl group having 1 to 8 carbon atoms, polyethylene oxide, a substituent having a poly(ϵ-caprolactone) structure, a substituent having a poly (δ-valerolactone) structure, and a substituent having a copolymer structure of ϵ-caprolactone and δ-valerolactone.

The polyester phosphate compound can have a number average molecular weight of 1000 or more and 50000 or less because the toner charging properties can be more significantly enhanced. These polyester phosphate compounds are used in an amount in the range of preferably 0.5 parts by mass or more and 20 parts by mass or less, more preferably 0.75 parts by mass or more and 10 parts by mass or less based on 100 parts by mass of the binder resin to further enhance the toner charging properties.

The atomic concentration of phosphorus (P %) of the outermost surface of the electro-conductive surface layer can satisfy $0.05 \leq P \leq 2.50$ to more significantly enhance the toner charging properties.

[Measurement of Atomic Concentration]

The atomic concentration of aluminum and the atomic concentration of phosphorus are measured by the following operations (1) to (3). Namely, the outermost surface of the developing member photographed with a field emission scanning electron microscope (trade name: JSM-7800F, manufactured by JEOL, Ltd.) is subjected to element analysis with an X-ray microanalysis system (trade name: NORAN System 7, manufactured by Thermo Fisher Scientific Inc.) to determine the atomic concentration of aluminum and the atomic concentration of phosphorus.

(1) Preparation of Sample

A 3 mm square of an electro-conductive surface layer of a developing member is cut out with a razor so as not to damage the outermost surface of the electro-conductive surface layer serving as a portion to be measured. A sample for measurement is thereby prepared. The sample for measurement has a thickness of 1.0 mm. If the sum of the thickness of the electro-conductive elastic layer and that of the electro-conductive surface layer of the developing member is 1.0 mm or less, the sample for measurement has a thickness equal to or more than the thickness of the electro-conductive surface layer. Next, an electro-conductive paste is slightly applied onto an aluminum sample stand (diameter of 12.5 mm×height of 5 mm), and the sample is placed on the stand with the outermost surface thereof facing upward. The sample stand is set on a sample holder (12.5 mm type).

(2) Acquisition of Image with Field Emission Scanning Electron Microscope

For observation and analysis with the field emission scanning electron microscope, the degrees of vacuum of the chambers included in the field emission scanning electron microscope are each set to values equal to or less than predetermined values. Namely, the degree of vacuum of an electron gun chamber (SIP-1) is set to $5.0\times10^{-7}$ Pa or less, the degree of vacuum of an intermediate chamber (SIP-2) disposed to prevent a reduction in the degree of vacuum of the electron gun chamber is set to $1.0\times10^{-4}$ Pa or less, and the degree of vacuum of a sample chamber is set to $1.0\times10^{-3}$ Pa or less.

The sample holder is inserted into the sample chamber in the enclosure of the field emission scanning electron microscope, and the Z-axis of the stage is moved such that a working distance (WD) is 10 mm. A lower detector (LED) is designated as a detector. After the sample holder is moved to a position for observation, an accelerating voltage of 10 kV is applied, and a current setting value is set to 8 (in the scale of the apparatus). A scan mode is set to fine 1. The focus at a magnification of ×500, brightness, and contrast are adjusted to obtain an image at arbitrary measurement place of the outermost surface of the sample.

(3) Element Analysis with X-ray Microanalysis System

Next, the image obtained is taken into the X-ray microanalysis system with the software attached. The entire area of the image (×500) is designated to perform element analysis. Next, only four elements of C, O, Al and P are selected from the detected elements to perform quantitative calculation. The atomic concentration of Al and the atomic concentration of P obtained at this time are acquired as the data on the atomic concentration of aluminum and the atomic concentration of phosphorus of the present invention. According to the operations above, arbitrary 30 points of the outermost surface of the sample are measured. From the obtained data, the arithmetic average of the atomic concentration of aluminum and that of the atomic concentration of phosphorus are measured, and are defined as the atomic concentration of aluminum and the atomic concentration of phosphorus of the present invention.

[Formation of Electro-conductive Surface Layer]

The electro-conductive surface layer includes an electro-conductive agent such as an electron conductive substance or an ion conductive substance in the binder resin, and the resistance of the electro-conductive surface layer is adjusted to an appropriate resistance region (volume resistivity) of preferably $10^3$ Ωcm or more and $10^{11}$ Ωcm or less, more preferably $10^4$ Ωcm or more and $10^{10}$ Ωcm or less. Electro-conductivity can be given to the electro-conductive surface layer by the same material such as an electron conductive substance or an ion conductive substance used in the same amount as those in the electro-conductive elastic layer.

The electro-conductive surface layer can contain a crosslinking agent, a plasticizer, a filler, an extender, a vulcanizing agent, a vulcanizing aid, a crosslinking aid, an antioxidant, an anti-aging agent, a processing aid and a leveling agent in the range not impairing the function. In an electro-conductive surface layer requiring surface roughness, a fine particle may be added to the electro-conductive surface layer to give roughness to the electro-conductive surface layer. Specifically, a fine particle of polyurethane resins, polyester resins, polyether resins, polyamide resins, acrylic resins and polycarbonate resins can be used. The fine particle can have a volume average particle size of 1.0 μm or more and 30 μm or less. The surface roughness (ten-point average roughness) Rzjis given by the fine particle can be 0.1 μm or more and 20 μm or less. Rzjis is measured based on JIS B0601 (1994).

The electro-conductive surface layer can be formed by any method such as mold molding, extrusion molding, injection molding or application molding. Application molding can be used. For example, materials for an electro-conductive surface layer are dispersed and mixed in a solvent to prepare a coating material. The coating material is applied onto the electro-conductive elastic layer, and is solidified by drying or cured by heating. The electro-conductive surface layer can be thereby formed. Dispersion and mixing can be performed with a known dispersion apparatus using beads such as a sand mill, a paint shaker, a DYNO-MILL or a pearl mill. Immersion coating, ring coating, spray coating or roll coating can be used as a coating method.

The electro-conductive surface layer has a thickness in the range of preferably 0.005 mm or more and 0.1 mm or less, more preferably 0.008 mm or more and 0.03 mm or less.

[Process Cartridge and Electrophotographic Image Forming Apparatus]

Figure 2:
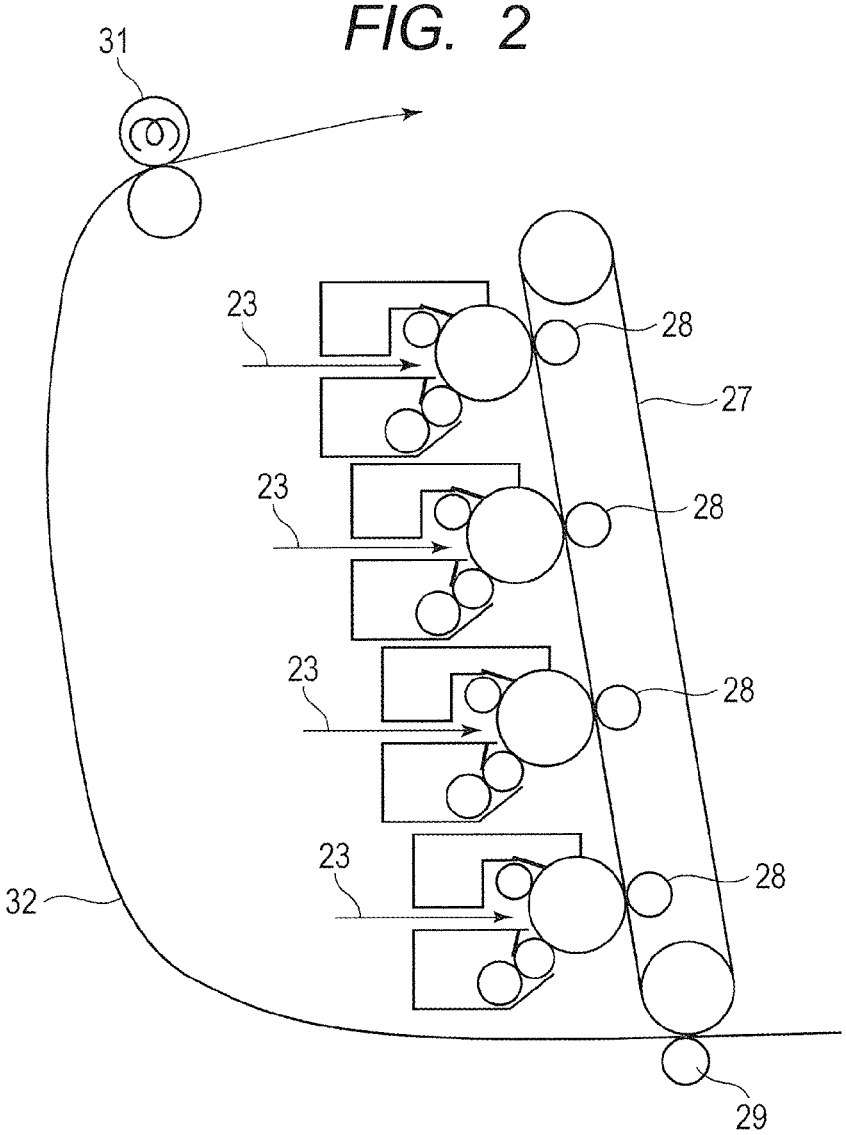
FIG. 2 is a schematic diagram illustrating one example of the electrophotographic image forming apparatus according to the present disclosure.

The electrophotographic image forming apparatus includes an image bearing member bearing an electrostatic latent image, a charging apparatus charging the image bearing member, an exposure apparatus forming an electrostatic latent image on the charged image bearing member, a developing apparatus developing the electrostatic latent image with a toner to form a toner image, and a transfer apparatus transferring the toner image onto a transfer material. FIG. 2 is a cross sectional view schematically illustrating the electrophotographic image forming apparatus of the present invention.

Figure 3:
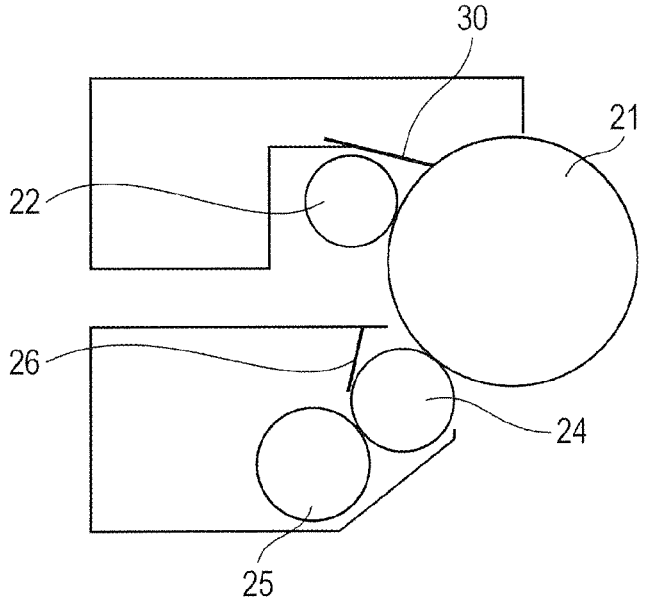
FIG. 3 is a schematic diagram illustrating one example of the process cartridge according to the present disclosure.

FIG. 3 is an enlarged cross sectional view of a process cartridge to be attached to the electrophotographic image forming apparatus in FIG. 2. The process cartridge includes an image bearing member 21 such as a photoreceptor drum, a charging apparatus including a charging member 22, a developing apparatus including a developing member 24, and a cleaning apparatus including a cleaning member 30, these components being incorporated into the process cartridge. The process cartridge is configured to be detachably attachable to the electrophotographic image forming apparatus of FIG. 2.

The image bearing member 21 is uniformly charged by the charging member 22 connected to a bias power supply not illustrated. At this time, the charging potential of the image bearing member 21 is −800 V or more and −400 V or less. Next, the image bearing member 21 is irradiated with exposure light 23 from an exposure apparatus not illustrated to write an electrostatic latent image. An electrostatic latent image is formed on the surface of the image bearing member 21. The exposure light 23 used can be LED light or laser light. The surface potential of exposed portions on the image bearing member 21 is −200 V or more and −100 V or less.

Next, a toner charged to a negative polarity by the developing member 24 is applied onto the electrostatic latent image (electrostatic latent image is developed) to form a toner image on the image bearing member 21. The electrostatic latent image is thereby converted into a visible image. At this time, a voltage of −500 V or more and −300 V or less is applied to the developing member 24 by the bias power supply not illustrated. The developing member 24 is in contact with the image bearing member 21 with a nip width of 0.5 mm or more and 3 mm or less. In the process cartridge of the present invention, a toner feed roller 25 is rotatably in contact with the developing member 24 upstream of rotation of the developing member 24 with respect to the contact region between a developing blade 26 as a toner regulating member and the developing member 24.

The toner image developed on the image bearing member 21 is primarily transferred onto an intermediate transfer belt 27. The rear surface of the intermediate transfer belt 27 is in contact with a primary transfer member 28. A voltage of +100 V or more and +1500 V or less is applied onto the primary transfer member 28 to primarily transfer the toner image having a negative polarity from the image bearing member 21 to the intermediate transfer belt 27. The primary transfer member 28 may be in the form of a roller or a blade.

If the electrophotographic image forming apparatus is a full-color image forming apparatus, the steps of charging, exposure, developing and primary transfer should be performed in each color of yellow, cyan, magenta and black. For this reason, four process cartridges in total containing the toners of the respective colors are detachably attached to the main body of the electrophotographic image forming apparatus illustrated in FIG. 2. The steps of charging, exposure, developing and primary transfer are sequentially performed at predetermined intervals of time to layer toner images of four colors on the intermediate transfer belt 27 to produce a full-color image.

The toner image on the intermediate transfer belt 27 is conveyed to a position facing a secondary transfer member 29 with rotation of the intermediate transfer belt 27. A recording paper is fed between the intermediate transfer belt 27 and the secondary transfer member 29 at a predetermined timing along a feed route 32 of the recording paper. A secondary transfer bias is applied to the secondary transfer member 29 to transfer the toner image on the intermediate transfer belt 27 onto the recording paper. At this time, the bias voltage applied to the secondary transfer member 29 is +1000 V or more and +4000 V or less. The recording paper after the toner image is transferred thereonto by the secondary transfer member 29 is fed to a fixing apparatus 31. The toner image on the recording paper is melted to be fixed onto the recording paper. The recording paper is then discharged to the outside of the electrophotographic image forming apparatus to complete the print operation.

The residual toner on the image bearing member 21 not transferred from the image bearing member 21 onto the intermediate transfer belt 27 is scraped off from the surface of the image bearing member 21 by the cleaning member 30 for cleaning to clean the surface of the image bearing member 21.

One aspect of the present invention can provide a developing member that is less likely to cause leakage of charges of the toner even under high temperature and high humidity environments to sufficiently charge the toner, and that can maintain high durability.

Another aspect of the present invention can provide a process cartridge and an electrophotographic image forming apparatus that can stably form high-quality electrophotographic images under a variety of environments.

EXAMPLES

The present invention will now be described in more detail by way of specific Examples. The technical scope of the present invention as the developing member will not be limited to these.

Production Example 1

Preparation of Polyester Monool 1

Materials shown in Table 1 were placed in a four-necked flask provided with a stirrer, a thermometer, a cooler and a nitrogen gas introducing pipe. Polymerization was performed under a nitrogen stream at 180° C. for 6 hours to prepare a reaction solution (2000 g).

Next, the reaction solution was fed to a mechanical vertical stirring thin film evaporator (manufactured by SIBATA SCIENTIFIC TECHNOLOGY LTD.) at a rate of 300 g per hour. ϵ-Caprolactone residues and self-dimers thereof generated were removed. The mechanical vertical stirring thin film evaporator includes an outer cylinder having an inner diameter of 50 mm and a length of 200 mm. The ϵ-caprolactone and self-dimers thereof generated were removed at an evaporator inner pressure of 0.25 mmHg, an outer cylinder inner temperature of the evaporator of 240° C., and the number of rotation of the wiper of 200 rpm. Polyester monool 1 of ϵ-caprolactone was thus prepared.

TABLE 1

| Materials | Parts by mass |
|---|---|
| ϵ-Caprolactone (caprolactone monomer, manufactured by Daicel Corporation (the former DAICEL CHEMICAL INDUSTRIES, LTD.)) | 1000 |
| n-Butanol (manufactured by Sigma-Aldrich Corporation) | 37 |
| Catalyst, stannous octylate catalyst (trade name: Stanoct, manufactured by Mitsubishi Chemical Corporation) | 0.05 |

Production Example 2

Preparation of Polyester Monool 2

Polyester monool 2 of δ-valerolactone was prepared in the same manner as in Production Example 1 except that the materials placed in a four-necked flask were replaced with materials shown in Table 2.

TABLE 2

| Materials | Parts by mass |
|---|---|
| δ-Valerolactone (manufactured by Sigma-Aldrich Corporation) | 877 |
| n-Butanol (manufactured by Sigma-Aldrich Corporation) | 37 |
| Catalyst stannous octylate catalyst (trade name: Stanoct, manufactured by Mitsubishi Chemical Corporation) | 0.05 |

Production Example 3

Preparation of Polyester Phosphate 1

Materials shown in Table 3 and 25 mL of N-methyl-2-pyrrolidone (manufactured by Sigma-Aldrich Corporation) and 25 mL of o-xylene (manufactured by Sigma-Aldrich Corporation) as solvents were placed in a 100 mL flask.

A pelletized molecular sieve 4A (about 9 mL) was put in a Soxhlet extractor. The extractor was attached to the flask, and a cooling tube was attached above the flask.

While the reaction solution in the flask was being stirred, the reaction solution was refluxed with heating in a 180° C. oil bath for 10 hours. The reaction solution was then cooled to room temperature to prepare polyester phosphate 1 having a structure represented by formula (3).

TABLE 3

| Materials | Parts by mass |
|---|---|
| Polyester monool 1 | 800 |
| ortho-Phosphoric acid (manufactured by Sigma-Aldrich Corporation) | 98 |
| Tri-n-butylamine (manufactured by Sigma-Aldrich Corporation) | 18.5 |

[Formula 3]

(3)

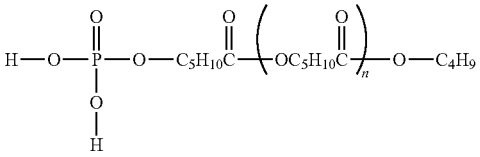

where "n" represents an integer of 1 or more.

Production Example 4

Preparation of Polyester Phosphate 2

Polyester phosphate 2 having a structure represented by formula (4) was prepared in the same manner as in Production Example 3 except that the materials placed in a flask were replaced with materials shown in Table 4.

TABLE 4

| Materials | Parts by mass |
|---|---|
| Polyester monool 2 | 800 |
| ortho-Phosphoric acid (manufactured by Sigma-Aldrich Corporation) | 49 |
| Tri-n-butylamine (manufactured by Sigma-Aldrich Corporation) | 18.5 |

[Formula 4]

(4)

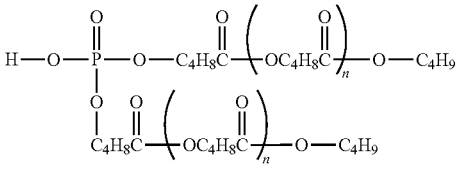

where two "n" each independently represent an integer of 1 or more.

Production Example 5

Preparation of Phosphorus Acid Ester A

Phosphorus acid ester A having a structure represented by formula (5) was prepared in the same manner as in Production Example 3 except that the materials placed in a flask were replaced with materials shown in Table 5.

TABLE 5

| Materials | Parts by mass |
|---|---|
| 1-Hexanol (manufactured by KISHIDA CHEMICAL Co., Ltd.) | 204 |
| ortho-Phosphoric acid (manufactured by Sigma-Aldrich Corporation) | 98 |
| Tri-n-butylamine (manufactured by Sigma-Aldrich Corporation) | 18.5 |

[Formula 5]

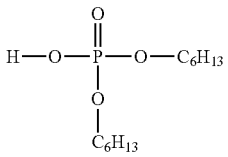

(5)

[Measurement of Number Average Molecular Weight]

The number average molecular weights (Mn) of polyester phosphate 1 and polyester phosphate 2 synthesized above were measured. The measurement was performed using the following apparatus and measurement conditions:

Apparatus for measurement: HLC-8120GPC (trade name, manufactured by Tosoh Corporation).

Columns: two columns of TSKgel SuperHZM-M (trade name, manufactured by Tosoh Corporation).

Solvent: THF.

Temperature: 40° C.

THF flow rate: 0.6 ml/min.

The sample for measurement was a 0.1% by mass solution in THF. The measurement was performed using a refractive index (RI) detector as a detector. Calibration curves were created using TSK standard polystyrenes (trade names, A-1000, A-2500, A-5000, F-1, F-2, F-4, F-10, F-20, F-40, F-80 and F-128; manufactured by Tosoh Corporation) as standard samples for creating calibration curves. The number average molecular weight was determined based on the calibration curves from the retention time of the sample for measurement obtained. As a result, polyester phosphate 1 had a number average molecular weight of 1910, and polyester phosphate 2 had a number average molecular weight of 3160.

Example 1

[1. Preparation of Electro-conductive Substrate]

A primer (trade name: DY35-051, manufactured by Dow Corning Toray Co., Ltd.) was applied onto a metal core made of SUS304 and having an outer diameter of 6 mm and a length of 264 mm, and the workpiece was heated at a temperature of 150° C. for 20 minutes to prepare an electro-conductive substrate.

[2. Formation of Electro-conductive Elastic Layer]

The electro-conductive substrate was concentrically disposed in a cylindrical metal mold having an inner diameter of 11.5 mm. The materials shown in Table 6 below as materials for an electro-conductive elastic layer were mixed with a Tri-mix (trade name: TX-15, manufactured by INOUE MFG., INC.) to prepare an addition silicone rubber composition, and the composition was injected into a metal mold heated to a temperature of 115° C. After the materials were injected, the materials were molded with heating at a temperature of 120° C. for 10 minutes, and were cooled to room temperature. The product was then removed from the metal mold to prepare elastic roller 1 having an electro-conductive elastic layer having a thickness of 2.71 mm formed on the outer periphery of the electro-conductive substrate.

TABLE 6

| Materials | Parts by mass |
|---|---|
| Liquid dimethylpolysiloxane having two or more silicon atom-bonding alkenyl groups in one molecule (trade name: SF3000E, manufactured by KCC Corporation), viscosity: 10000 cP, vinyl group equivalent: 0.05 mmol/g | 100 |
| Platinum catalyst (trade name: SIP6832.2, manufactured by Gelest, Inc.) | 0.048 |
| Dimethylpolysiloxane having two or more silicon atom-bonding hydrogen atoms in one molecule (trade name: SP6000P, manufactured by KCC Corporation), Si—H group equivalent: 15.5 mmol/g | 0.5 |
| Carbon black (trade name: TOKABLACK #7360SB, manufactured by Tokai Carbon Co., Ltd.) | 6 |

[3. Formation of Electro-conductive Surface Layer]

Next, the materials shown in Component (1) of Table 7 below were mixed by stirring as materials for an electro-conductive surface layer. Subsequently, the mixture was dissolved in methyl ethyl ketone (manufactured by Sigma-Aldrich Corporation) such that the solid content was 30% by mass, and was mixed. The solution was then uniformly dispersed with a sand mill. Methyl ethyl ketone was added to the mixed solution to adjust the solid content to 25% by mass. The materials shown in Component (2) of Table 7 were added to the mixed solution, and were dispersed by stirring with a ball mill to prepare coating material 1 for an electro-conductive surface layer.

Elastic roller 1 was coated with the coating material through immersion in the coating material such that the film thickness of the coating material was about 15 μm. Subsequently, the workpiece was heated at a temperature of 130° C. for 60 minutes to prepare developing roller 1 having an electro-conductive surface layer formed on the electro-conductive elastic layer. The atomic concentration of aluminum and the atomic concentration of phosphorus on the outermost surface of the electro-conductive surface layer are shown in Table 11.

TABLE 7

| | Materials | Parts by mass |
|---|---|---|
| Component (1) | Polyester polyol (trade name: NIPPOLAN 3027, manufactured by Tosoh Corporation) | 50 |
| | Isocyanate (trade name: CORONATE 2233, manufactured by Tosoh Corporation) | 50 |
| | Alumina particle (trade name: ASFP-20, manufactured by Denka Company Limited (the former DENKI KAGAKU KOGYO KABUSHIKI KAISHA)) | 30 |
| | Polyester phosphate 1 | 2 |
| | Lithium bis(trifluoromethanesulfonyl)imide (manufactured by KISHIDA CHEMICAL Co., Ltd.) | 2 |

TABLE 7-continued

| | Materials | Parts by mass |
|---|---|---|
| Component (2) | Polyurethane resin particle (trade name: Art-pearl C400, manufactured by Negami Chemical Industrial Co., Ltd.) | 15 |

Examples 2 to 10 and Comparative Examples 1 and 2

Developing rollers 2 to 12 were prepared in the same manner as in Example 1 except that the amount of alumina particle used and the type and the amount of polyester phosphate used in coating material 1 for an electro-conductive surface layer were varied as shown in Table 11. No polyester phosphate was used in Comparative Example 1. No alumina particle was used in Comparative Example 2. The atomic concentration of aluminum and the atomic concentration of phosphorus of the outermost surface of the electro-conductive surface layer are shown in Table 11.

Comparative Example 3

Elastic roller 13 was prepared in the same manner as in Example 1. The materials shown in Component (1) of Table 8 below were mixed by stirring. Subsequently, the mixture was dissolved and mixed in methyl ethyl ketone (manufactured by Sigma-Aldrich Corporation) such that the total solid content ratio was 30% by mass, and was uniformly dispersed with a sand mill. Methyl ethyl ketone was added to the mixed solution to adjust the solid content to 25% by mass. The materials shown in Component (2) of Table 8 were added to the mixed solution, and were dispersed by stirring with a ball mill to prepare coating material 13-1 for an electro-conductive surface layer (first layer).

Elastic roller 13 was coated with the coating material through immersion in the coating material such that the film thickness of the coating material was about 15 μm. Subsequently, the workpiece was heated at a temperature of 130° C. for 60 minutes to prepare roller 13-1 having an electro-conductive surface layer (first layer) having a thickness of 14.8 μm formed on the electro-conductive elastic layer.

Next, an alumina sol solution (trade name: AS-520, manufactured by Nissan Chemical Industries, Ltd.) and ethanol were blended in a volume ratio of 1:4, and were mixed by stirring to prepare a colloidal alumina solution.

Roller 13-1 was coated with the colloidal alumina solution through immersion in the solution to form an electro-conductive surface layer (second layer) having a thickness of 1.5 μm on the electro-conductive surface layer (first layer). Developing roller 13 was thereby prepared.

TABLE 8

| | Materials | Parts by mass |
|---|---|---|
| Component (1) | Polyester polyol (trade name: NIPPOLAN 3027, manufactured by Tosoh Corporation) | 50 |
| | Isocyanate (trade name: CORONATE 2233, manufactured by Tosoh Corporation) | 50 |
| | Carbon black (trade name: MA230, manufactured by Mitsubishi Chemical Corporation) | 25 |

TABLE 8-continued

| | Materials | Parts by mass |
|---|---|---|
| Component (2) | Polyurethane resin particle (trade name: Art-pearl C400, manufactured by Negami Chemical Industrial Co., Ltd.) | 15 |

Comparative Example 4

Developing roller 14 was prepared in the same manner as in Example 1 except that Component (1) of the coating material for forming an electro-conductive surface layer in Example 1 were replaced with the materials shown in Component (1) of Table 9.

TABLE 9

| | Materials | Parts by mass |
|---|---|---|
| Component (1) | Polyester polyol (trade name: NIPPOLAN 3027, manufactured by Tosoh Corporation) | 50 |
| | Isocyanate (trade name: CORONATE 2233, manufactured by Tosoh Corporation) | 50 |
| | Alumina particle (trade name: AO-502, manufactured by Admatechs Company Limited) | 30 |
| | Phosphorus acid ester A | 2 |
| | Lithium bis(trifluoromethanesulfonyl)imide (manufactured by KISHIDA CHEMICAL Co., Ltd.) | 2 |
| Component (2) | Polyurethane resin particle (trade name: Art-pearl C400, manufactured by Negami Chemical Industrial Co., Ltd.) | 15 |

Comparative Example 5

Developing roller 15 was prepared in the same manner as in Example 1 except that Component (1) of the coating material for forming an electro-conductive surface layer in Example 1 were replaced with the materials shown in Component (1) of Table 10.

TABLE 10

| | Materials | Parts by mass |
|---|---|---|
| Component (1) | Polyester polyol (trade name: NIPPOLAN 3027, manufactured by Tosoh Corporation) | 50 |
| | Isocyanate (trade name: CORONATE 2233, manufactured by Tosoh Corporation) | 50 |
| | Alumina particle (trade name: ASFP-20, manufactured by Denka Company Limited) | 3 |
| | Quaternary phosphonium salt (trade name: HISHICOLIN ETPP-FB, manufactured by Nippon Chemical Industrial Co., Ltd.) | 5 |
| | Lithium bis(trifluoromethanesulfonyl)imide (manufactured by KISHIDA CHEMICAL Co., Ltd.) | 2 |
| Component (2) | Polyurethane resin particle (trade name: Art pearl C400, manufactured by Negami Chemical Industrial Co., Ltd.) | 15 |

[Method for Evaluation]

Each of the developing rollers produced in Examples 1 to 10 and Comparative Examples 1 to 5 was attached to a process cartridge for a color laser printer. The toner charging properties were evaluated using this color laser printer (trade name: LBP5050, manufactured by Canon Inc.). The results of evaluation are shown in Table 11. A cyan toner contained in the cyan process cartridge of the color laser printer was used as it was. The evaluation was performed according to the following procedures.

[1. Initial Evaluation]

The cyan process cartridge was left under an environment at a temperature of 30° C. and a relative humidity of 95% for 4 hours, and a solid white image having a coverage rate of 0% was then output onto a recording paper under the same environment. The color laser printer was turned off during printing. At this time, the charging amount Q/M (μC/g) of the toner on the developing roller before passing through the nip between the photosensitive member and the developing roller was measured.

Figure 4:
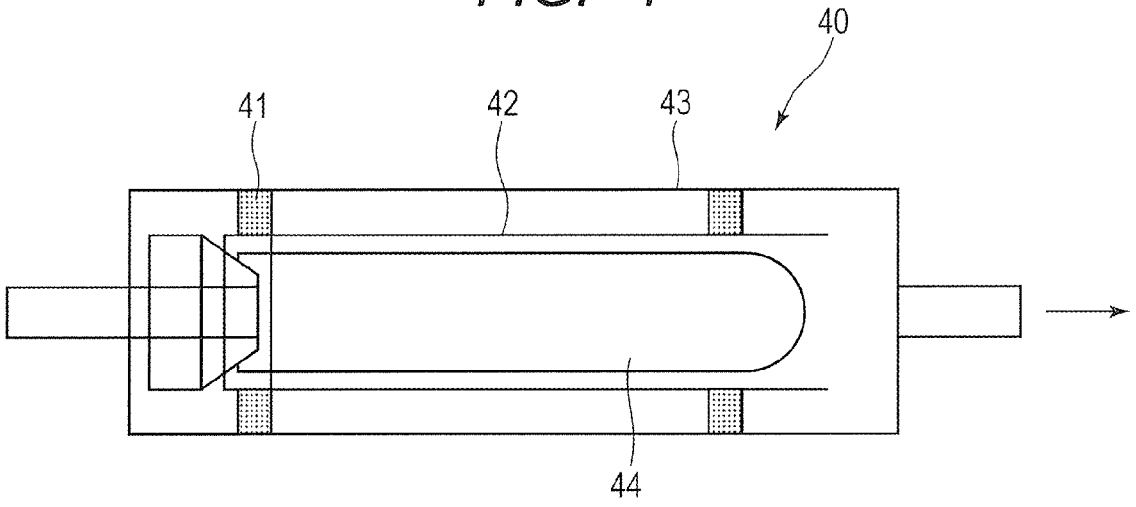
FIG. 4 is a schematic view illustrating a cylinder filter used in measurement of a charging amount (Q/M) of a toner.

The specific method of measuring the charging amount of the toner is illustrated in FIG. 4. Namely, the toner on the developing roller is suctioned by air with a Faraday cage 40 including a double cylinder including metal cylinders, i.e., an internal cylinder 42 and an external cylinder 43 having different axial diameters and coaxially disposed, and a filter (trade name: Thimble Filter No. 86R, 17×20×90, manufactured by ADVANTEC Group) 44 for taking the toner into the internal cylinder 42. In the Faraday cage 40, the internal cylinder 42 and the external cylinder 43 are insulated with an insulation member 41. A toner taken into the filter 44 causes electrostatic induction by the charge amount Q of the toner. The charge amount Q of induced charge is measured with a Coulomb meter (KEITHLEY 616 DIGITAL ELECTROMETER, manufactured by Keithley Instruments, Inc.), and is divided by the mass M of the toner suctioned into the filter 44 to determine the charging amount Q/M (μC/g) of the toner.

This operation is repeated 10 times per developing roller to measure the charging amount of the toner 10 times. The arithmetic average is determined, and is defined as the charging amount of the toner of the developing roller.

[2. Evaluation after Developing Member is Left for 10 Days]

The cyan process cartridge used in the initial evaluation was left under an environment at a temperature of 30° C. and a relative humidity of 95% for 10 days. A solid white image having a coverage rate of 0% was then output onto a recording paper under the same environment. The color laser printer was turned off during printing. At this time, the charging amount Q/M (μC/g) of the toner on the developing roller before passing through the nip between the photosensitive member and the developing roller was measured by the same method as above.

TABLE 11

| | | Materials for electro-conductive surface layer (parts by mass) | | | | | Atomic concentration (%) | | Charging amount of toner, Q/M (μC/g) | |
|---|---|---|---|---|---|---|---|---|---|---|
| | | Alumina particle | | Polyester | Polyester | | | | | After developing member is left |
| | | [ASFP-20] | [AO-052] | Phosphate 1 | phosphate 2 | Others | Aluminum | Phosphorus | Initial | for 10 days |
| Example | 1 | 30 | — | 2 | — | | 4.04 | 0.13 | −73.8 | −70.1 |
| | 2 | 3 | — | 10 | — | | 1.50 | 2.49 | −71.2 | −68.0 |
| | 3 | 3 | — | 0.75 | — | | 1.51 | 0.05 | −70.5 | −67.1 |
| | 4 | 200 | — | 0.75 | — | | 10.20 | 0.05 | −76.3 | −72.8 |
| | 5 | 200 | — | 10 | — | | 10.00 | 2.50 | −75.9 | −72.4 |
| | 6 | 60 | — | — | 8 | | 5.56 | 2.00 | −73.9 | −70.8 |
| | 7 | 150 | — | — | 5 | | 8.11 | 1.03 | −74.1 | −70.1 |
| | 8 | — | 1.5 | — | 3 | | 0.98 | 0.51 | −67.2 | −63.5 |
| | 9 | — | 30 | — | 20 | | 4.03 | 3.11 | −74.0 | −70.0 |
| | 10 | — | 350 | — | 5 | | 11.80 | 0.95 | −75.3 | −71.5 |
| Comparative Example | 1 | 3 | — | — | — | | 1.58 | 0.00 | −50.5 | −47.7 |
| | 2 | — | — | — | 5 | | 0.00 | 1.10 | −38.2 | −32.1 |
| | 3 | — | — | — | — | Alumina sol solution | 7.21 | 0.00 | −52.1 | −49.5 |
| | 4 | — | 30 | — | — | Phosphorus acid ester A | 3.89 | 0.14 | −53.8 | −50.4 |
| | 5 | 3 | — | — | — | Quaternary phosphonium salt | 1.55 | 1.20 | −51.2 | −48.3 |

Example 11

The following materials were mixed, and were dispersed with a sand mill using glass beads having a diameter of 1 mm as a medium particle for 1 hour to prepare coating material 2 for an electro-conductive surface layer.

Binder resin: resol phenolic resin (trade name: J-325, manufactured by DIC Corporation) 20 parts Carbon black (trade name: TOKABLACK #5500, manufactured by Tokai Carbon Co., Ltd.) 10 parts 2-Propanol (isopropyl alcohol, manufactured by KISHIDA CHEMICAL Co., Ltd.) 50 parts Alumina particle (trade name: ASFP-20, manufactured by Denka Company Limited) 30 parts Polyester phosphate 1 2 parts As an electro-conductive substrate, a ground aluminum cylindrical tube having an outer diameter of 16.0 mm and an arithmetic average roughness Ra of 0.2 μm and having both ends masked was provided. The electro-conductive substrate was vertically placed. While the substrate was being rotated at a constant rate, coating material 2 ejected from a spray gun descending at a constant rate was applied onto the substrate such that the film thickness was 12 μm. The coating was then cured by heating at a temperature of 150° C. for 30 minutes to form an electro-conductive surface layer on the electro-conductive substrate. A developing sleeve was thereby prepared.

Comparative Example 6

A developing sleeve was prepared in the same manner as in Example 11 except that alumina particle and polyester phosphate 1 were not used.

The atomic concentrations of aluminum and the atomic concentrations of phosphorus of the electro-conductive surface layers of the developing members according to Example 11 and Comparative Example 6 are shown in Table 12.

[Method for Evaluation]

Each of the developing sleeves produced in Example 11 and Comparative Example 6 was attached to a process cartridge of a monochromatic laser printer. The toner charging properties were evaluated using this monochromatic laser printer (trade name: LaserJet P3015n, manufactured by Hewlett-Packard Company). The results of evaluation are shown in Table 12. The monochromatic toner contained in the process cartridge of the monochromatic laser printer was used as it was. The evaluation was performed according to the following procedures.

[1. Initial Evaluation]

The process cartridge was left under an environment at a temperature of 30° C. and a relative humidity of 95% for 4 hours, and a solid white image having a coverage rate of 0% was then output onto a recording paper under the same environment. The monochromatic laser printer was turned off during printing. At this time, the charging amount Q/M (μC/g) of the toner on the developing sleeve before a toner flying region to the photosensitive member was measured.

A specific method of measuring the charging amount of the toner is illustrated in FIG. 4. Namely, the toner on the developing sleeve is suctioned by air with a Faraday cage 40 including a double cylinder including metal cylinders, i.e., an internal cylinder 42 and an external cylinder 43 having different axial diameters and coaxially disposed, and a filter (trade name: Thimble Filter No. 86R, 17×20×90, manufactured by ADVANTEC Group) 44 for taking the toner into the internal cylinder 42. In the Faraday cage 40, the internal cylinder 42 and the external cylinder 43 are insulated with an insulation member 41. A toner taken into the filter 44 causes electrostatic induction by the charge amount Q of the toner. The charge amount Q of induced charge is measured with a Coulomb meter (KEITHLEY 616 DIGITAL ELECTROMETER, manufactured by Keithley Instruments, Inc.), and is divided by the mass M of the toner suctioned into the filter 44 to determine the charging amount Q/M (μC/g) of the toner.

This operation is repeated 10 times per developing sleeve to measure the charging amount of the toner 10 times. The arithmetic average is determined, and is defined as the charging amount of the toner of the developing sleeve.

[2. Evaluation after Developing Sleeve is Left for 10 Days]

The process cartridge used in the initial evaluation was left under an environment at a temperature of 30° C. and a relative humidity of 95% for 10 days. A solid white image having a coverage rate of 0% was then output onto a recording paper under the same environment. The monochromatic laser printer was turned off during printing. At this time, the charging amount Q/M (μC/g) of the toner on the developing sleeve before a toner flying region to the photosensitive member was measured by the same method as above.

TABLE 12

| | Atomic concentration | | Charging amount of toner, Q/M | |
|---|---|---|---|---|
| | | | | After developing sleeve |
| | Aluminum | Phosphorus | Initial | is left for 10 days |
| Example 11 | 3.99 | 0.15 | −45.2 | −43.6 |
| Comparative Example 6 | 0 | 0 | −10.5 | −7.1 |

[Discussion of Results of Evaluation]

The developing rollers in Examples 1 to 10 including electro-conductive surface layers containing an alumina particle and polyester phosphate demonstrated significantly high toner charging properties under a high temperature and high humidity (temperature of 30° C., relative humidity of 95%) environment. The developing rollers in Comparative Examples 1, 3, 4 and 5 including electro-conductive surface layers containing at least alumina had high toner charging properties and were highly useful in practical use, but the toner charging properties were not equal to those of the developing rollers having the configuration of the present invention.

The developing roller in Example 9 contained a large amount of polyester phosphate, resulting in slightly inferior long-term storage characteristics of the coating material for the electro-conductive surface layer. The developing roller in Example 10 contained a large amount of the alumina particle, resulting in slight unevenness of the coating formed on the surface of the developing roller through immersion. However, these are not problematic in practical use. Accordingly, the developing rollers in the present Examples were very useful as developing members having high toner charging properties under high temperature and high humidity environments, which have not been found in conventional developing rollers.

As is clear from Example 11 and Comparative Example 6, the developing member including an electro-conductive surface layer containing an alumina particle and polyester phosphate was very useful in the monochromatic magnetic toners, which have not conventionally had a high charging amount of a toner under high temperature and high humidity environments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-208985, filed Oct. 23, 2015, which is hereby incorporated by reference herein in its entirety.

What is claimed is:

1. A developing member comprising an electro-conductive substrate and an electro-conductive surface layer in this order, the surface layer comprising a binder resin, an alumina particle and a polyester phosphate compound having a structure represented by Formula 1:

(1)

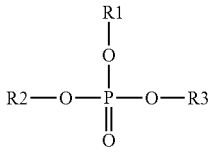

wherein at least one of R1 to R3 is a substituent having a polyester structure, with the proviso that (i) if one of R1, R2 and R3 is a substituent having a polyester structure, the other two are a hydrogen atom, an alkyl group, an alkenyl group, an aralkyl group, an aryl group or a polyoxyalkylene group, and (ii) if two of R1, R2 and R3 are substituents having a polyester structure, the other is a hydrogen atom, an alkyl group, an alkenyl group, an aralkyl group, an aryl group or a polyoxyalkylene group.

2. The developing member according to claim 1, wherein an electro-conductive elastic layer is interposed between the substrate and the surface layer.

3. The developing member according to claim 1, wherein an atomic concentration of aluminum (Al %) of the outermost surface of the surface layer satisfies $1.50 \leq Al \leq 10.0$.

4. The developing member according to claim 1, wherein an atomic concentration of phosphorus (P %) of the outermost surface of the surface layer satisfies $0.05 \leq P \leq 2.50$.

5. The developing member according to claim 1, wherein R1 is selected from the group consisting of a substituent having a poly(ϵ-caprolactone) structure, a substituent having a poly(δ-valerolactone) structure, and a substituent having a copolymer structure of ϵ-caprolactone and δ-valerolactone; and R2 and R3 are each independently selected from the group consisting of a hydrogen atom, an alkyl group having 1 to 8 carbon atoms, polyethylene oxide, a substituent having a poly(ϵ-caprolactone) structure, a substituent having a poly(δ-valerolactone) structure, and a substituent having a copolymer structure of ϵ-caprolactone and δ-valerolactone.

6. The developing member according to claim 1, wherein the polyester phosphate compound has a number average molecular weight of 1000 to 50000.

7. The developing member according to claim 1, wherein the surface layer has a thickness of 0.005 to 0.1 mm.

8. A process cartridge configured to be detachably attachable to a main body of an electrophotographic apparatus, the process cartridge comprising a developing apparatus, the developing apparatus comprising a developing member, the developing member comprising an electro-conductive substrate and an electro-conductive surface layer in this order, and the surface layer comprising a binder resin, an alumina particle and a polyester phosphate compound having a structure represented by Formula 1:

(1)

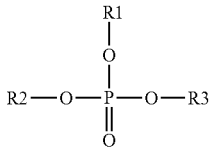

wherein at least one of R1 to R3 is a substituent having a polyester structure, with the proviso that (i) if one of R1, R2 and R3 is a substituent having a polyester structure, the other two are a hydrogen atom, an alkyl group, an alkenyl group, an aralkyl group, an aryl group or a polyoxyalkylene group, and (ii) if two of R1, R2 and R3 are substituents having a polyester structure, the other is a hydrogen atom, an alkyl group, an alkenyl group, an aralkyl group, an aryl group or a polyoxyalkylene group.

9. n electrophotographic image forming apparatus comprising an image bearing member bearing an electrostatic latent image, a charging apparatus charging the image bearing member, an exposure apparatus forming an electrostatic latent image on the charged image bearing member, a developing apparatus developing the electrostatic latent image with a toner to form a toner image, and a transfer apparatus transferring the toner image onto a transfer material, the developing apparatus comprising a developing member, the developing member comprising an electro-conductive substrate and an electro-conductive surface layer in this order, and the surface layer comprising a binder resin, an alumina particle and a polyester phosphate compound having a structure represented by Formula 1:

(1)

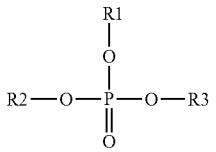

wherein at least one of R1 to R3 is a substituent having a polyester structure, with the proviso that (i) if one of R1, R2 and R3 is a substituent having a polyester structure, the other two are a hydrogen atom, an alkyl group, an alkenyl group, an aralkyl group, an aryl group or a polyoxyalkylene group, and (ii) if two of R1, R2 and R3 are substituents having a polyester structure, the other is a hydrogen atom, an alkyl group, an alkenyl group, an aralkyl group, an aryl group or a polyoxyalkylene group.

* * * * *